US007699415B2

(12) United States Patent
Tseng et al.

(10) Patent No.: US 7,699,415 B2
(45) Date of Patent: Apr. 20, 2010

(54) DRAWER SLIDE LOCATING SYSTEM

(75) Inventors: I-Ming Tseng, Kaohsiung Hsien (TW); Wei-Sheng Wang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 784 days.

(21) Appl. No.: 11/484,811

(22) Filed: Jul. 12, 2006

(65) Prior Publication Data

US 2007/0040485 A1 Feb. 22, 2007

(30) Foreign Application Priority Data

Aug. 22, 2005 (TW) ..... 94128670 A

(51) Int. Cl.
*A47B 88/00* (2006.01)

(52) U.S. Cl. ..... 312/333; 312/334.45

(58) Field of Classification Search .....
312/334.44–334.47, 333, 334.1, 334.7–334.11, 312/334.15–334.17, 334.25, 334.26, 334.33, 312/334.36–334.38; 384/18, 21
See application file for complete search history.

(56) References Cited

U.S. PATENT DOCUMENTS

| | | | | |
|---|---|---|---|---|
| 3,801,166 | A | 4/1974 | York | |
| 4,252,382 | A | 2/1981 | Thomas | |
| 5,466,060 | A | 11/1995 | Hoffman | |
| 5,577,821 | A | 11/1996 | Chu | |
| 5,722,750 | A | 3/1998 | Chu | |
| 6,145,945 | A | 11/2000 | Parvin | |
| 6,220,683 | B1 | 4/2001 | Chu | |
| 6,254,210 | B1 | 7/2001 | Parvin | |
| 6,257,683 | B1 | 7/2001 | Yang | |
| 6,296,338 | B1 | 10/2001 | Stijns | |
| 6,386,660 | B1 | 5/2002 | Yang | |
| 6,390,575 | B1 | 5/2002 | Chen et al. | |
| 6,402,275 | B1 | 6/2002 | Yang | |
| 6,450,600 | B1 * | 9/2002 | Chen et al. | 312/334.46 |
| 6,454,372 | B1 | 9/2002 | Yang | |
| 6,655,763 | B2 | 12/2003 | Judge et al. | |
| 6,715,851 | B1 | 4/2004 | Yang | |
| 6,820,954 | B2 | 11/2004 | Judge et al. | |
| 6,851,773 | B2 | 2/2005 | Chen et al. | |
| 6,860,574 | B2 | 3/2005 | Hwang et al. | |
| 6,899,408 | B2 * | 5/2005 | Chen et al. | 312/334.44 |
| 6,997,611 | B2 * | 2/2006 | Chen et al. | 384/21 |
| 7,111,913 | B2 * | 9/2006 | Dubon | 312/333 |

(Continued)

FOREIGN PATENT DOCUMENTS

| | | |
|---|---|---|
| JP | 5-15790 | 4/1993 |

(Continued)

*Primary Examiner*—Janet M Wilkens
(74) *Attorney, Agent, or Firm*—Rosenberg, Klein & Lee

(57) ABSTRACT

A drawer slide locating system includes an outer rail having a bracket at its front end, an inner rail, and a bearing carrier disposed between the inner rail and the outer rail. The bracket contains a locking piece toward the bearing carrier. Two wings extend from both sides of the locking piece to define a leverage axis. A slot is disposed on the outer rail. The locking piece having one lower end adapted with a hooking portion and another end being held against by the bearing carrier. The hooking portion raises to hold against the bottom of the bearing carrier and secure the bearing carrier in place.

5 Claims, 16 Drawing Sheets

U.S. PATENT DOCUMENTS

| | | | | |
|---|---|---|---|---|
| 7,357,468 | B2 * | 4/2008 | Hwang et al. | 312/333 |
| 7,520,577 | B2 * | 4/2009 | Chen et al. | 312/334.46 |
| 2002/0089273 | A1 | 7/2002 | Weng | |
| 2002/0175605 | A1 * | 11/2002 | Chen et al. | 312/333 |
| 2005/0017613 | A1 | 1/2005 | Cirocco et al. | |
| 2005/0062379 | A1 | 3/2005 | Judge et al. | |
| 2006/0163983 | A1 * | 7/2006 | Wu | 312/333 |
| 2008/0150409 | A1 * | 6/2008 | Huang et al. | 312/334.46 |

FOREIGN PATENT DOCUMENTS

| | | |
|---|---|---|
| JP | 2562231 | 11/1994 |
| TW | 278338 | 6/1996 |
| TW | 310560 | 7/1997 |
| TW | 491055 | 6/2002 |
| TW | 200412881 | 8/2004 |
| TW | M268985 | 7/2005 |

* cited by examiner

DRAWER SLIDE LOCATING SYSTEM

BACKGROUND OF THE INVENTION (a) Field of the Invention

The present invention relates to a drawer slide locating system, and more particularly, to one capable of controlling extended status of an inner rail, and locating the inner rail when pulled out and disengaged from the system by means of a locking hook to secure a bearing carrier that holds against the inner rail; and to automatically lead away the bearing carrier when the inner rail is inserted into the system once again to facilitate guiding the retraction of the inner rail.

(b) Description of the Prior Art

A slide used for a drawer or similar object is usually comprised of two or three sections of sliding rails to slide on those rails by means of one set or two sets of bearing mounted among those rails. A bearing carrier is provided to contain rollers to roll on the rails for the bearing carrier to movably connect to the sliding rails. Whereas it is necessarily in most cases to remove the drawer or similar object mounted on the slide by the furniture manufacturer or the consumer, the slide is provided with the function of disengaging the drawer or similar object from the slide, either in the configuration of two or three sections, essentially by pulling out the rails connected to the drawer or similar object. To consider the necessity of restoring the drawer or similar object to the slide and maintain the normal mechanism of the product, the bearing carrier providing the connection by sliding must be located at the front end of a fixed rail upon pulling out the rails so to facilitate the rails to be once again inserted into the bearing carrier and further guided into the linear tract of the roller.

The prior art to locate the bearing carrier at the front end of the rails has been taught in Taiwanese Publication Nos. 252316 (please refer to the Background of U.S. Pat. No. 5,577,821), 491054 (U.S. Pat. No. 6,454,372), 491055, 498730 (U.S. Pat. Nos. 5,722,750 and 6,220,683), M248319 (U.S. Pat. No. 6,145,945), M268985, and Invention Early Publication No. 200412881 in Taiwan; and U.S. Pat. Nos. 3,801,166, 4,252,382, 5,466,060, 5,577,821, 5,722,750, 6,145,945, 6,220,683 B1, 6,254,210 B1, 6,296,338 B1, 6,390,575 B1, 6,655,763 B2, 6,715,851 B1, 6,820,954 B2, 6,851,773 B2, and 6,860,574 B2; US Patent Early Publication Nos. US 2002/0089273 A1, US 2005/0017613 A1, and US 2005/0062379 A1; and Japanese Patent Nos. 5-15790 and 2562231 is the prior art that the applicant of the present invention is familiar with.

Furthermore, in the means of the art to control the retraction and separation of the slide, an inner rail of the prior art generally referred in the trade (usually connected to a drawer or similar object) is disposed with a limiting piece while an outer rail (connected to a cabinet or a frame for installation) is provided at its front end a bracket to hold against the limiting piece; or alternatively, a middle rail is connected to the outer rail first before being connected to the inner rail to constitute a three-section slide. In such case, a bracket is disposed at the front end of the middle rail. The pattern featuring the limiting piece and the bracket to hold against each other prevents the inner rail from being disengaged or controls to cause the limiting piece to clear off the bracket to permit retraction and separation of the inner rail. As taught in the prior arts including Taiwan Patent Nos. 252316 (please refer to the Background of U.S. Pat. No. 5,577,821), 278338, 310560, 450055 (U.S. Pat. No. 6,257,683), 491054 (U.S. Pat. No. 6,454,372), 502587 (U.S. Pat. No. 6,386,660), 521603 (U.S. Pat. No. 6,402,275), and 556521(U.S. Pat. No. 6,715,851).

Whereas the bearing carrier of the prior art as described above is located at the end of the rail and is achieved by being "temporarily" held and locked by elasticity, the elastic structure to execute such holding and locking is vulnerable to be worn by friction and winds up soonest failure or poor function as far as the operation mode of the bearing carrier is concerned.

Furthermore, in the prior art of having the limiting piece and the bracket to hold against each other, once the inner rail is pulled out, there is the absence of a buffer between the limiting piece and the bracket to compromise the silence and operating hand touch of the slide. The possible friction between the middle rail and the outer rail also presents a problem.

SUMMARY OF THE INVENTION

The primary purpose of the present invention is to provide a slide location system to correct those problems found with the prior art. To achieve the purpose, one solution includes a drawer slide comprised of an inner rail and an outer rail, a bracket disposed to one end of the outer rail, and a limiting piece is disposed on the inner side of the inner rail. Wherein, a locking piece is disposed between the rails at where in relation to a bearing carrier; the locking piece having two wings respectively extending from both sides functions as a leverage axis. One end of the locking piece is made lower than the bottom of the bearing carrier while the other end permits to be held against by the bottom of the bearing carrier while a hooking portion is disposed to the lower end of the locking piece. Accordingly, as the bearing carrier approaches the locking piece, the hooking portion first slips into the bottom of the bearing carrier and raises to hold against the bottom of the bearing carrier once the latter compresses another end of the locking piece to execute locating by holding against the bearing carrier.

In another solution, both wings respectively extending from both sides of the locking piece connected to the bearing carrier; a hooking portion rises from the front end of the locking piece; on the surface of the outer rail or on the bracket, a retaining surface for the hooking portion of the locking piece to hold against, and a protruding portion to push against one end of the locking piece for the hooking portion to hold against the retaining surface are disposed so that the bearing carrier upon reaching where the protrusion is provided, it is secured in place with the hooking portion of the locking piece holding against the retaining surface.

In another solution yet, the limiting piece inserted onto the inner side of the inner rail is made slightly sliding with one end disposed with an elastic ring so as to move to hold against a retainer disposed to the inner rail; and when the inner rail is externally pulled in relation to the outer rail, the limiting piece holds against the bracket with the elastic ring from the limiting piece to bump against the retainer of the inner rail to provide cushioning effect.

In a further solution yet to prevent the abnormal friction between the middle rail and the outer rail, a fender disposed with two spacers is provided on the front end of the outer rail; two locking studs and two locking blocks are disposed on the bottom of the fender; two locking holes are disposed through the fender; locating holes and buckling pieces are provided on the outer rail in relation to the locking studs and the locking holes for alignment and fixation; and the locking blocks are inserted into punched holes for the outer rail to be secured in place with the fender while a better lubricated friction between the fender and the middle rail is achieved.

The present invention provides the following improvements in comparison of the prior art:

a. Whereas the bearing carrier is secured in place by the locking piece working in the fashion of an leverage, the locking piece will not be vulnerable to accelerated tear and wear to warrant longer service life.

b. A cushioning effect is produced when the limiting piece has its elastic ring to hold against the bracket to help reduce the noise level and improve the hand touch of operation of the slide.

c. The fender disposed at the front end of the outer rail produces better lubricated contact with the middle rail to effectively reduce the abnormal sound, and tear and wear.

DETAILED DESCRIPTION OF THE PREFERRED EMBODIMENTS

Figure 1:
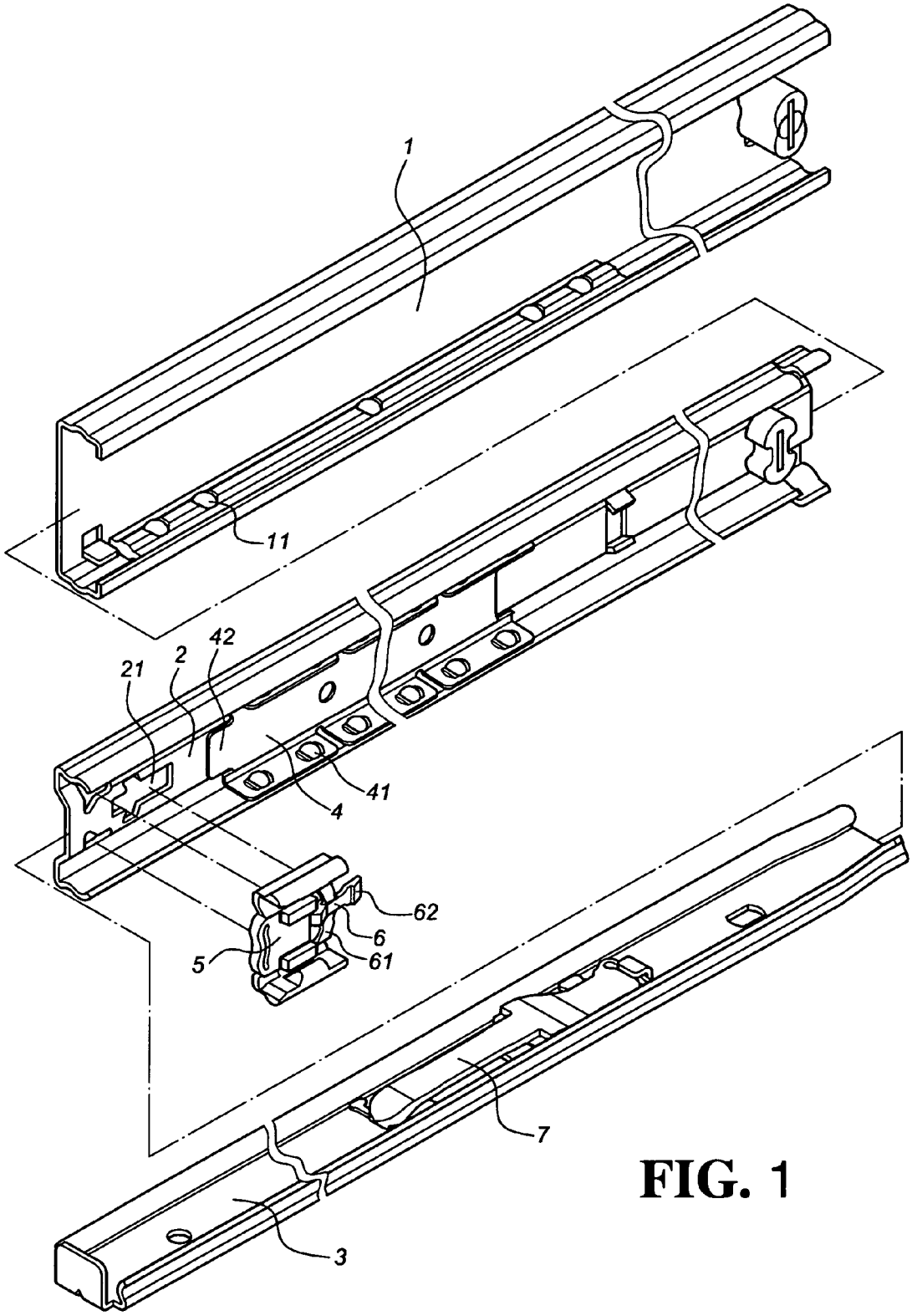
FIG. 1 is an exploded view of a first preferred embodiment of the present invention.
Figure 2:
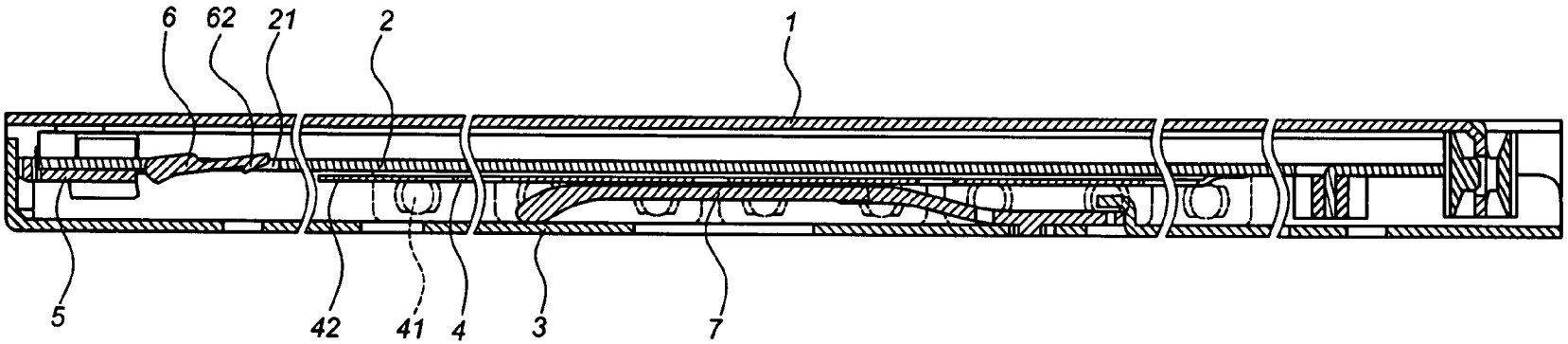
FIG. 2 is a schematic view showing that the first preferred embodiment of the present invention is retracted.
Figure 3:
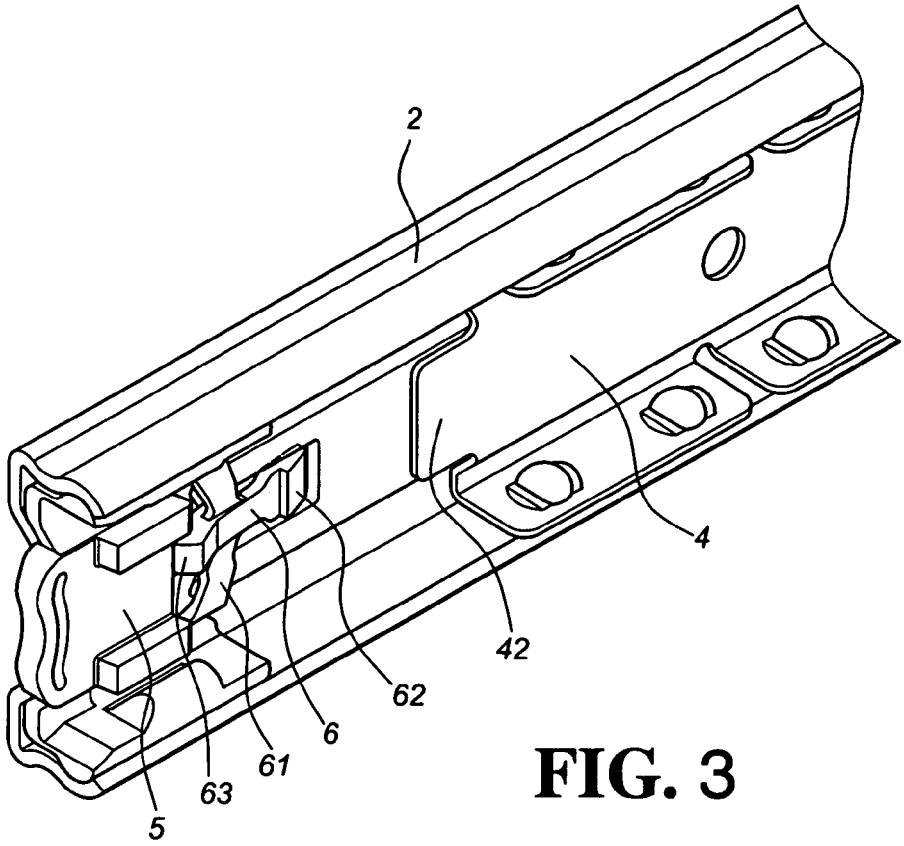
FIG. 3 is a schematic view showing a local construction of the first preferred embodiment of the present invention.
Figure 4:
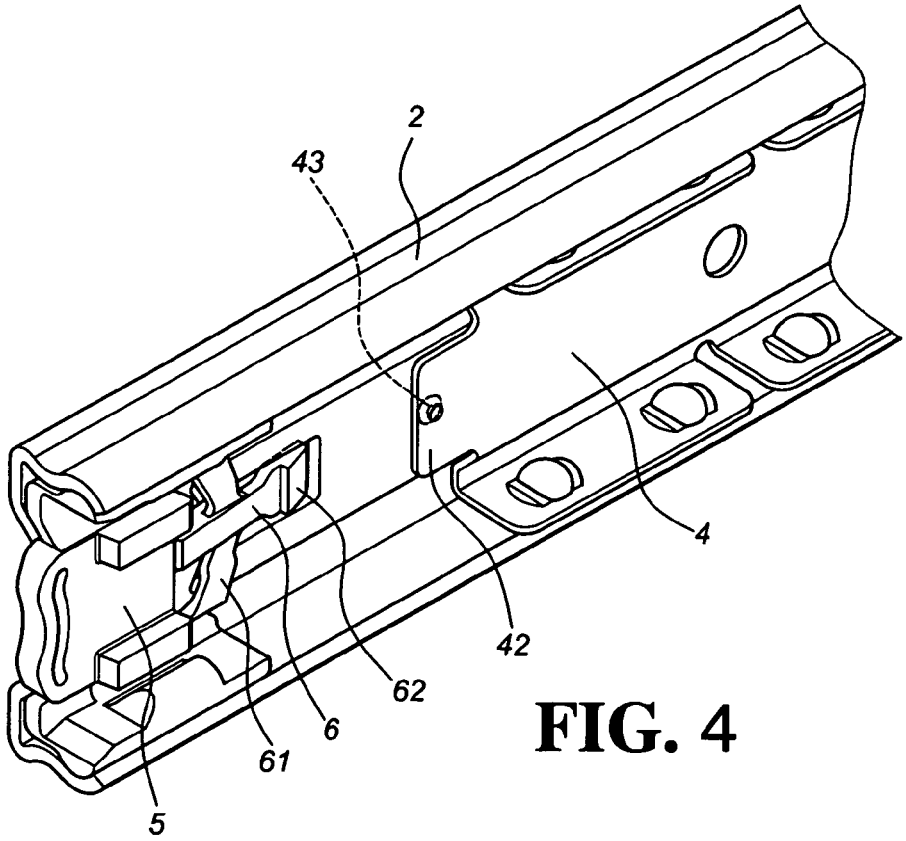
FIG. 4 is another schematic view showing the local construction of the first preferred embodiment of the preset invention.
Figure 5:
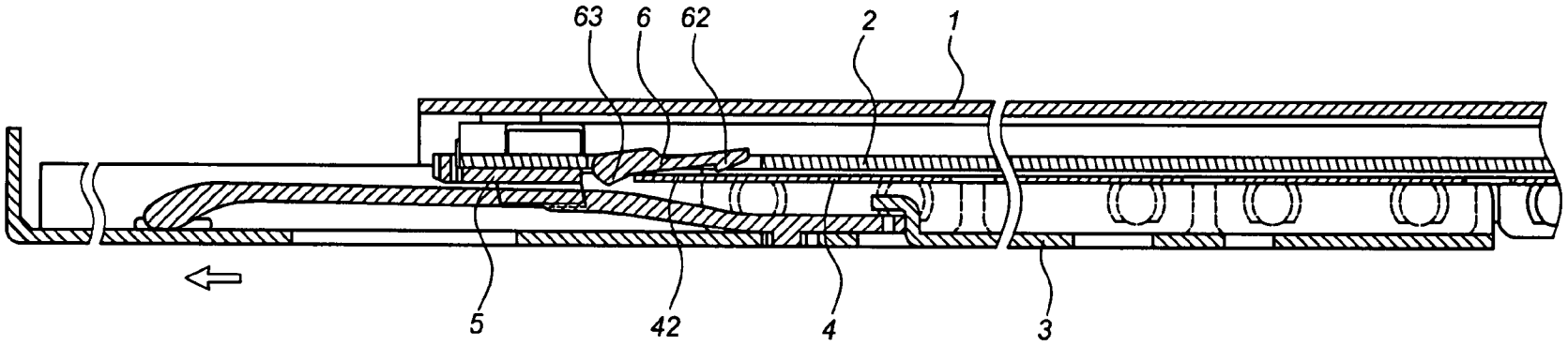
FIG. 5 is a schematic view showing the location of a bearing carrier in the first preferred embodiment of the present invention.
Figure 6:
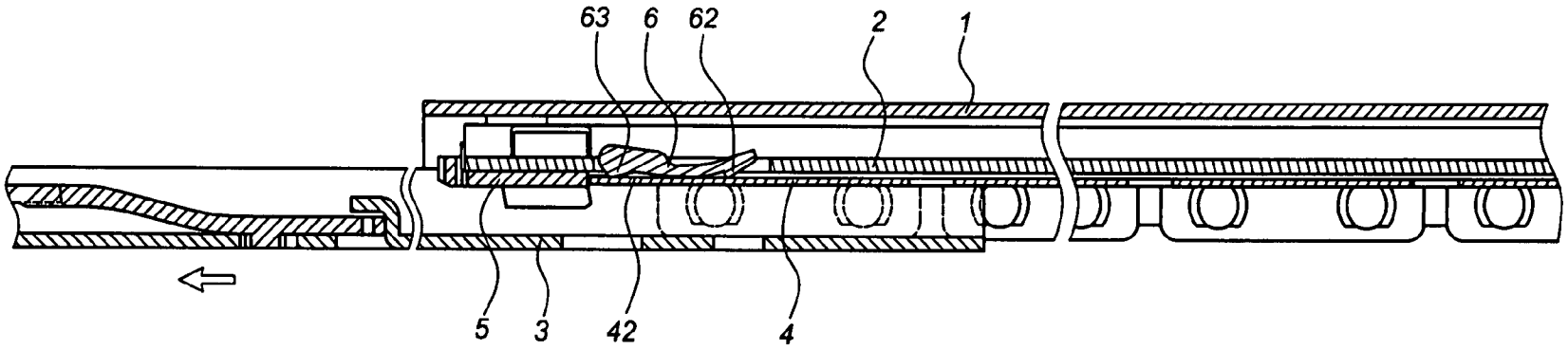
FIG. 6 is another schematic view showing the location of the bearing carrier in the first preferred embodiment of the present invention.

Referring to FIG. 1, a slide related to a three-section construction includes an outer rail (1), a middle rail (2), and an inner rail (3). Two ball bearings (11) are provided on the channel between the outer rail (1) and the middle rail (2), and a bearing carrier (1) containing balls (41) is disposed at where between the middle rail (2) and the inner rail (3). In the event of a two-section slide, the form of either of the outer rail (1) or the middle rail (2) is changed for both the outer rail (1) and the middle rail (2) are jointly referred as an "outer rail" to accommodate the bearing carrier (4) and the insertion by the inner rail (3) in conjunction with certain devices to be described below. However, the design of the two-section slide has been disclosed in the prior art and will be appreciated by a person of skill in the art. Characteristics of the present invention will be disclosed in a first preferred embodiment as illustrated in FIGS. 1 and 2. A bracket (5) is disposed to the front end of the middle rail (2) and a locking piece (6) is formed on the bracket (5) in the direction of facing the bearing carrier (4). A leverage axis is defined by the bracket (5) and the locking piece (6) having two winds (61) respectively extending from both sides of the locking piece (6) and connected to the bracket (5). A slot (21) corresponding to and in a size slightly greater than that of the locking piece (6) is disposed on the middle rail (2). One end of the locking piece (6) is lower than the bottom of the bearing carrier (4) while the other end of the locking piece (6) is to be held against by the bottom of a protruding plate (42) disposed at the front end of the bearing carrier (4). A hooking portion (62) is provided to the lower end of the locking piece (6). As illustrated in FIG. 3, the construction of the end of the locking piece (6), holding against the bottom of the bearing carrier (4), is related to a protrusion (63) or as illustrated in FIG. 4 to a convex (43) formed on the bottom of the protruding plate (42) of the bearing carrier (4). According, in locating the bearing carrier (4) as illustrated in FIGS. 3 and 5, when the bearing carrier (4) is pulled out along with the inner rail (3) and brought to approach the locking piece (6), the hooking portion (62) of the locking piece (6) first slips onto the bottom of the bearing carrier (4) and when the protruding plate (42) of the bearing carrier (4) compresses and holds against the other end of the locking piece (6) as illustrated in FIG. 6, the hooking portion (62) of the locking piece (6) and the abutted connection section rise, and is deflected and deformed to hold against the bottom of the bearing carrier (4) to secure it in place.

Figure 7:
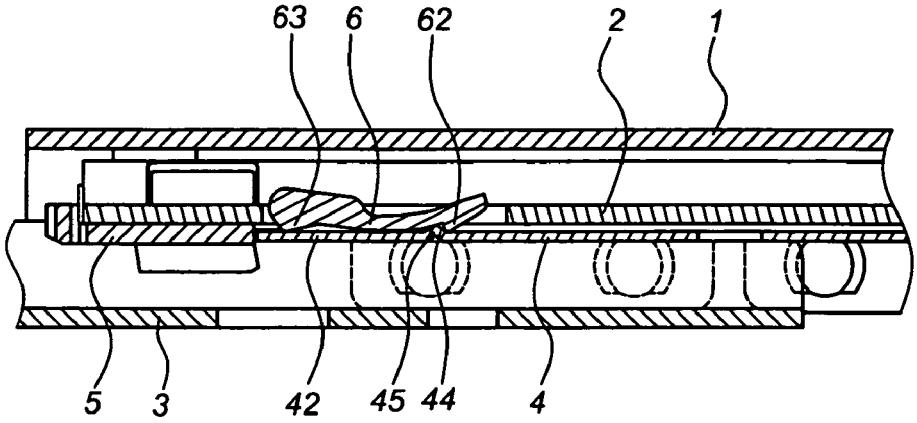
FIG. 7 is a schematic view showing a local construction of the bearing carrier in the first preferred embodiment of the present invention.
Figure 8:
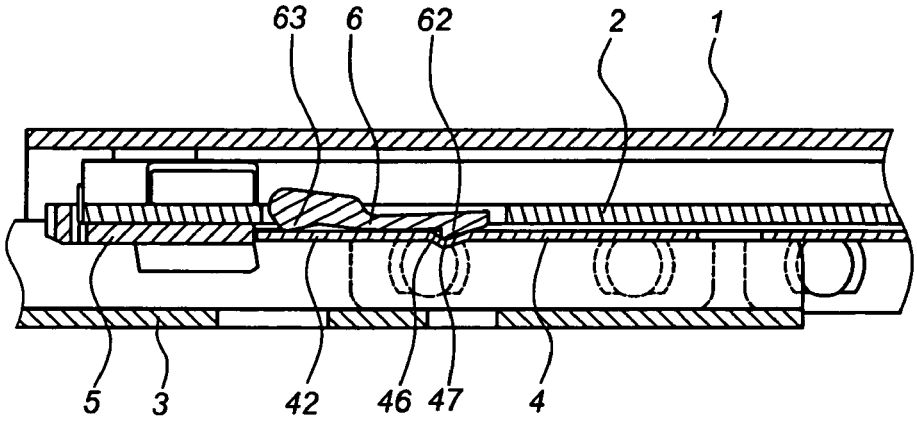
FIG. 8 is another schematic view showing a local construction of the bearing carrier in the first preferred embodiment of the present-invention.
Figure 9:
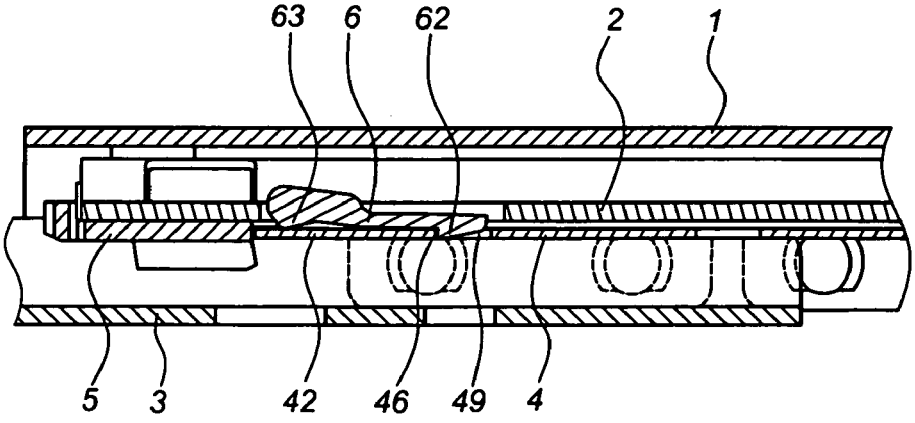
FIG. 9 is another schematic view yet showing a local construction of the bearing carrier in the first preferred embodiment of the present invention.

A retaining surface (44) is further provided to the bearing carrier (4) in the direction facing one end of the locking piece (6). As illustrated in FIG. 7, the retaining surface (44) is a raised side of a protrusion (45); or as illustrated in FIG. 8 a retaining surface (46) related to an inwardly concave of a pit (47); or a retaining surface (48) related to an inner edge surface of a through hole (49) to further secure the location of the bearing carrier (4) by having the retaining surface (44), (46) or (48) to hold against the locking portion (62) of the locking piece (6).

Figure 10:
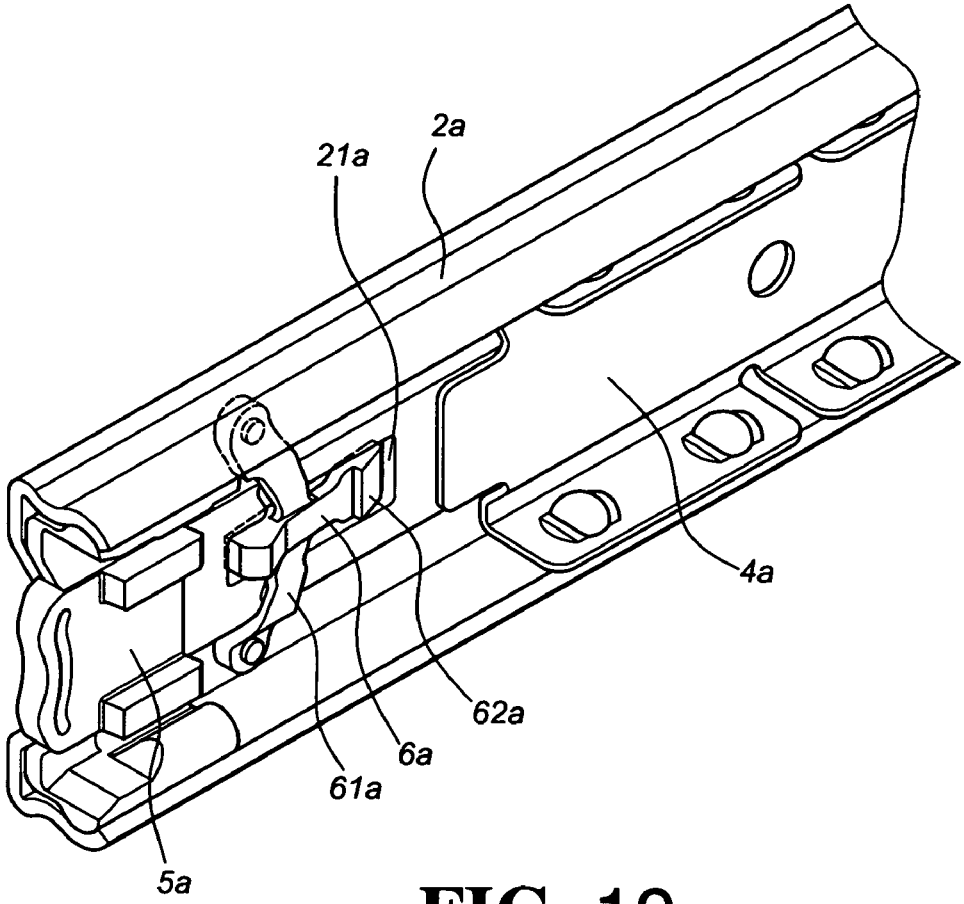
FIG. 10 is a schematic view showing a construction of a second preferred embodiment of the present invention.
Figure 11:
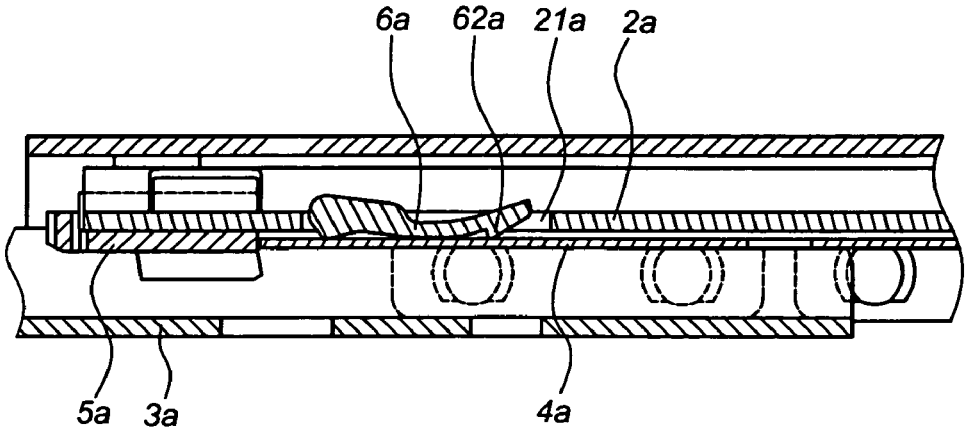
FIG. 11 is a schematic view showing the location of the bearing carrier in the second preferred embodiment of the present invention.

In a second preferred embodiment of the present invention as illustrated in FIGS. 10 and 11, a locking piece (6*a*) and a bracket (5*a*) are separated from each other. Two wings (61*a*) respectively extending from both sides of the locking piece (6*a*) are secured on both sides of a slot (21*a*) of a middle rail (2*a*). When a bearing carrier (4*a*) is pulled out along with an inner rail (3*a*) to approach the locking piece (6*a*), the bearing carrier (4*a*) first compresses on the higher end of the locking piece (6*a*) and then a hooking portion (62*a*) of the locking piece (6*a*) holds against the bottom of the bearing carrier (4*a*) to secure it in place.

Figure 12:
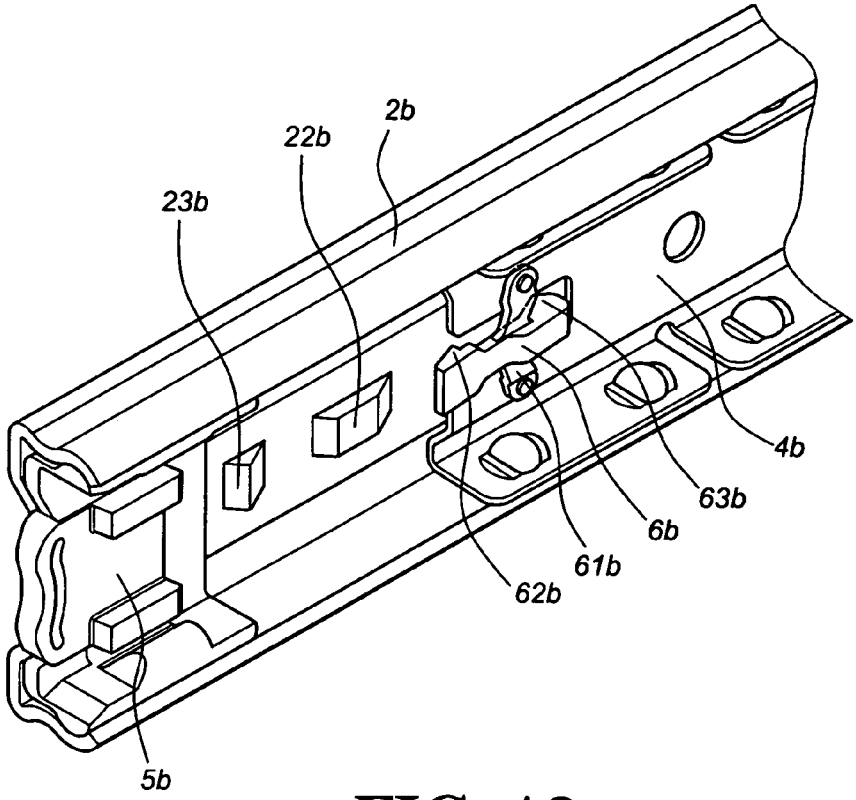
FIG. 12 is a schematic view showing a construction of a third preferred embodiment of the present invention.
Figure 13:
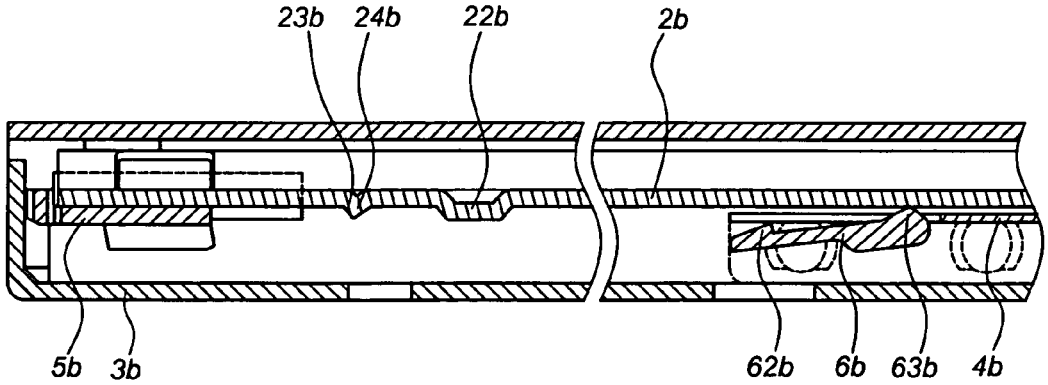
FIG. 13 is a schematic view showing that the third preferred embodiment of the present invention is retracted.
Figure 14:
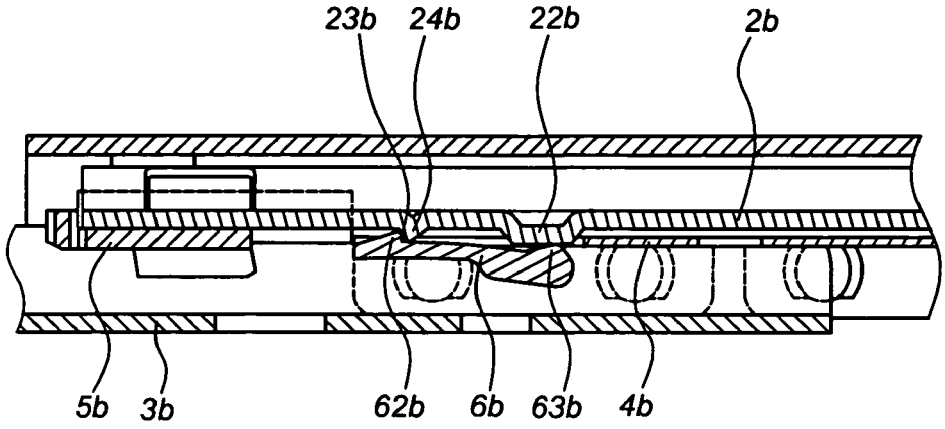
FIG. 14 is a schematic view showing the location of the bearing carrier in the third preferred embodiment of the present invention.
Figure 15:
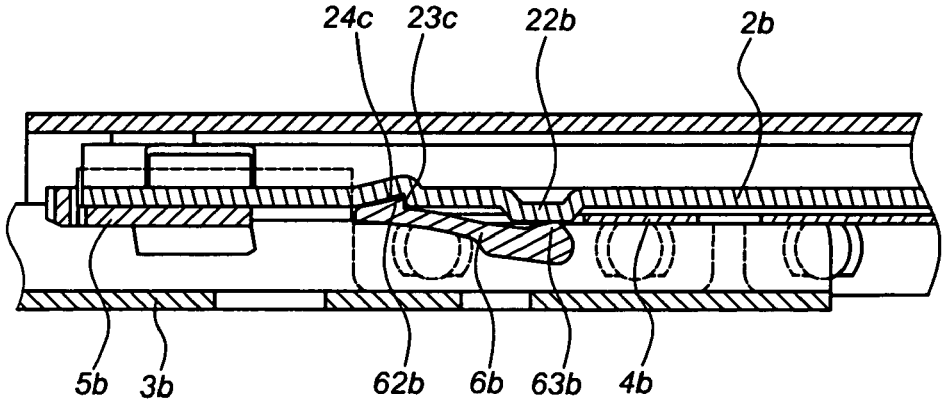
FIG. 15 is a schematic view showing a local construction of the third preferred embodiment of the present invention.
Figure 16:
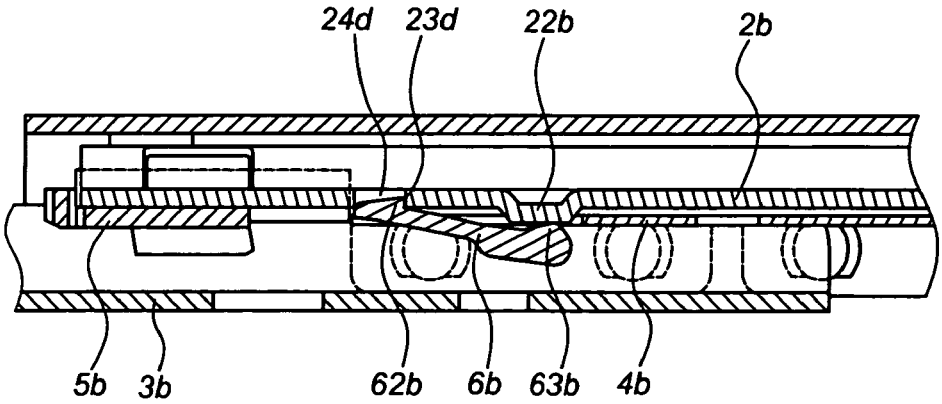
FIG. 16 is another schematic view showing the local construction of the third preferred embodiment of the present invention.

In a third preferred embodiment of the present invention as illustrated in FIGS. 12 and 13, two wings (61*b*) respectively extending from both sides of a locking piece (6*b*) are fixed to a bearing carrier (4*b*). The locking piece (6*b*) has a higher front end and a lower rear end. The front end is of the locking piece (6*b*) is disposed with a hooking portion (62*b*) and the rear end of the locking piece (6*b*) is disposed with a protrusion (63*b*). A protruding potion (22*b*) and a retaining surface (23*b*) are disposed to a middle rail (2*b*). When the bearing carrier (4*b*) along with an inner rail (3*b*) is pulled out and brought to approach a bracket (5*b*) as illustrated in FIG. 14, the locking piece (6*b*) swings by having the protrusion (63*b*) at its rear end to hold against the protruding portion (22*b*) of the middle rail (2*b*), so that the hooking portion (62*b*) at the front end of the locking piece (6*b*) holds against the retaining surface (23*b*) of the middle rail (2*b*). Wherein, as illustrated in FIG. 14, the retaining surface (23*b*) is a raised side of a protrusion (24*b*); or as illustrated in FIG. 15 a retaining surface (23*c*) related to an inwardly concave of a pit (24*c*); or a retaining surface (23*d*) related to an inner edge surface of a through hole (24*d*).

Figure 17:
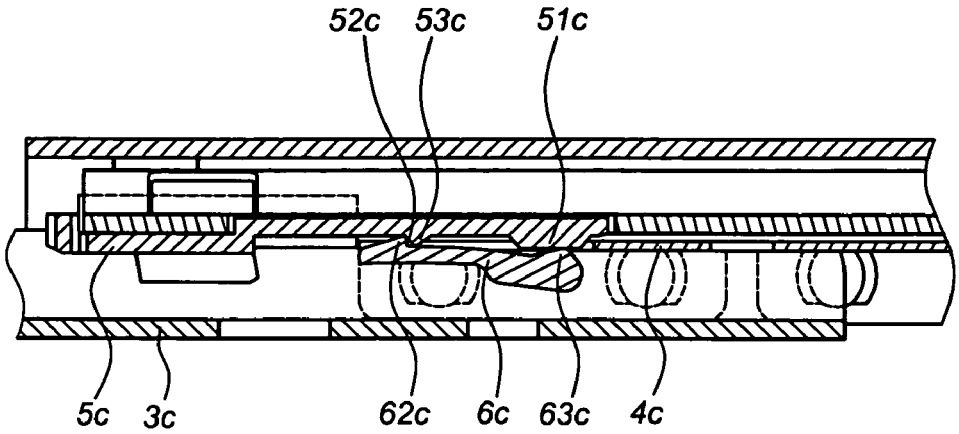
FIG. 17 is a schematic view showing the location of the bearing carrier in a fourth the second preferred embodiment of the present invention.
Figure 18:
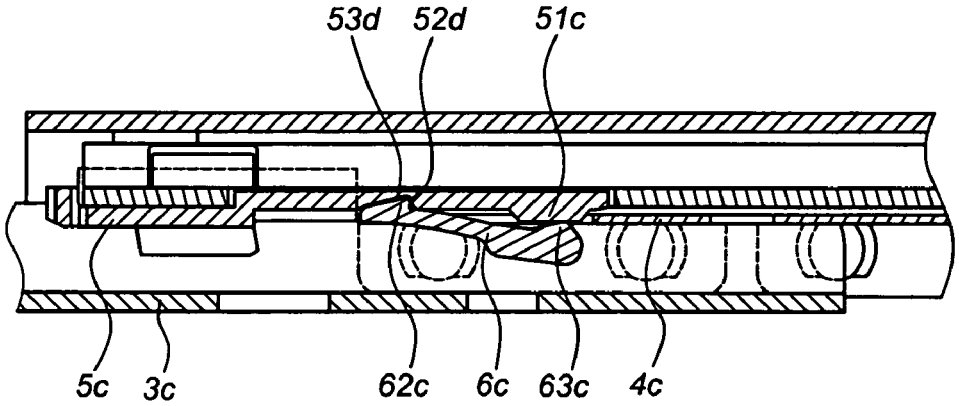
FIG. 18 is a schematic view showing a local construction of a bracket in the fourth preferred embodiment of the present invention.
Figure 19:
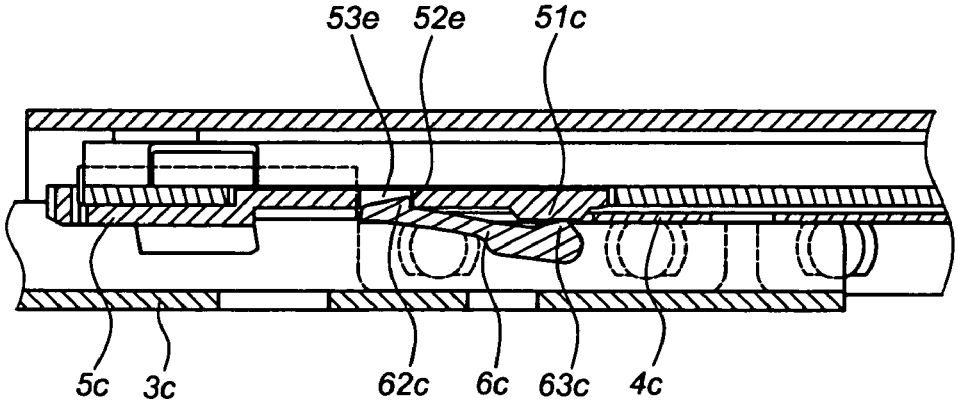
FIG. 19 is another schematic view showing the local construction of the bracket in the fourth preferred embodiment of the present invention.

In a fourth preferred embodiment, a protruding portion (51*c*) and a retaining surface (52*c*) are disposed on a bracket (5*c*). When a bearing carrier (4*c*) and a locking piece (6*c*) are pulled out along with an inner rail (3*c*) and brought to approach the bracket (5*c*) as illustrated in FIG. 17, the locking piece (6*c*) swings by having a protrusion (63*c*) at its rear end to hold against the protruding portion (51*c*) of the bracket (5*c*), so that a hooking portion (62*c*) at the front end of the locking piece (6*c*) holds against the retaining surface (52*c*) of the bracket (5*c*). Wherein, as illustrated in FIG. 17, the retaining surface (52*c*) is a raised side of a protrusion (53*c*); or as illustrated in FIG. 18 a retaining surface (52*d*) related to an inwardly concave of a pit (53*d*); or a retaining surface (52*e*) related to an inner edge surface of a through hole (53*e*).

Figure 20:
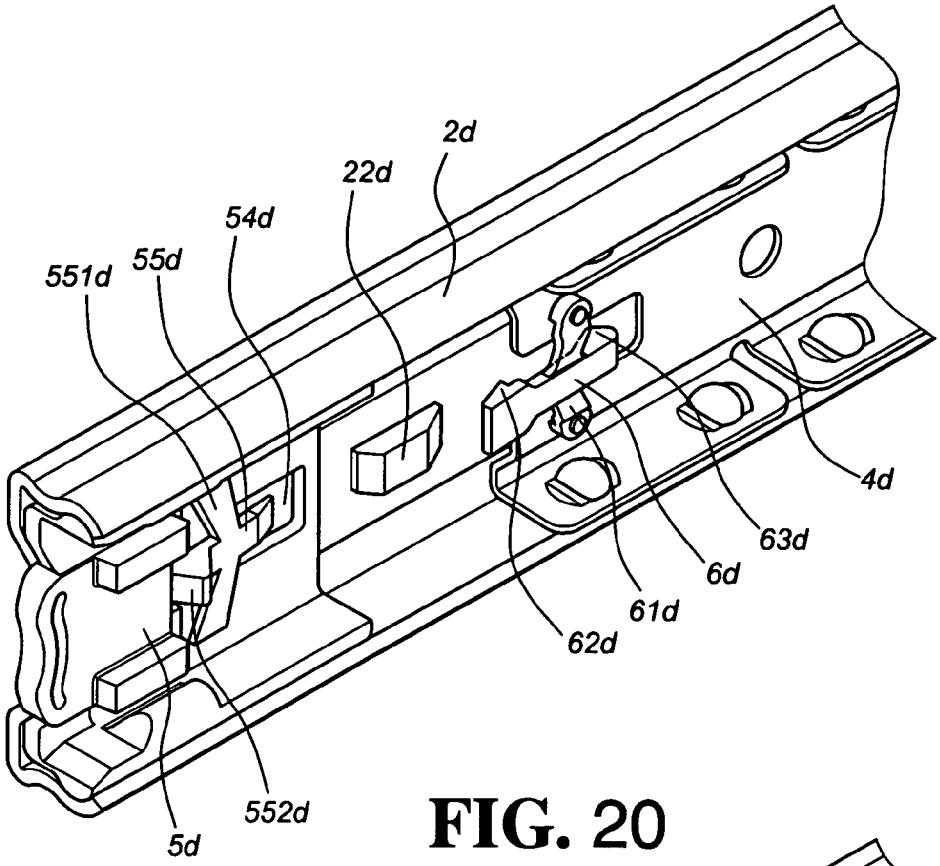
FIG. 20 is a schematic view showing a construction of a fifth preferred embodiment of the present invention.
Figure 21:
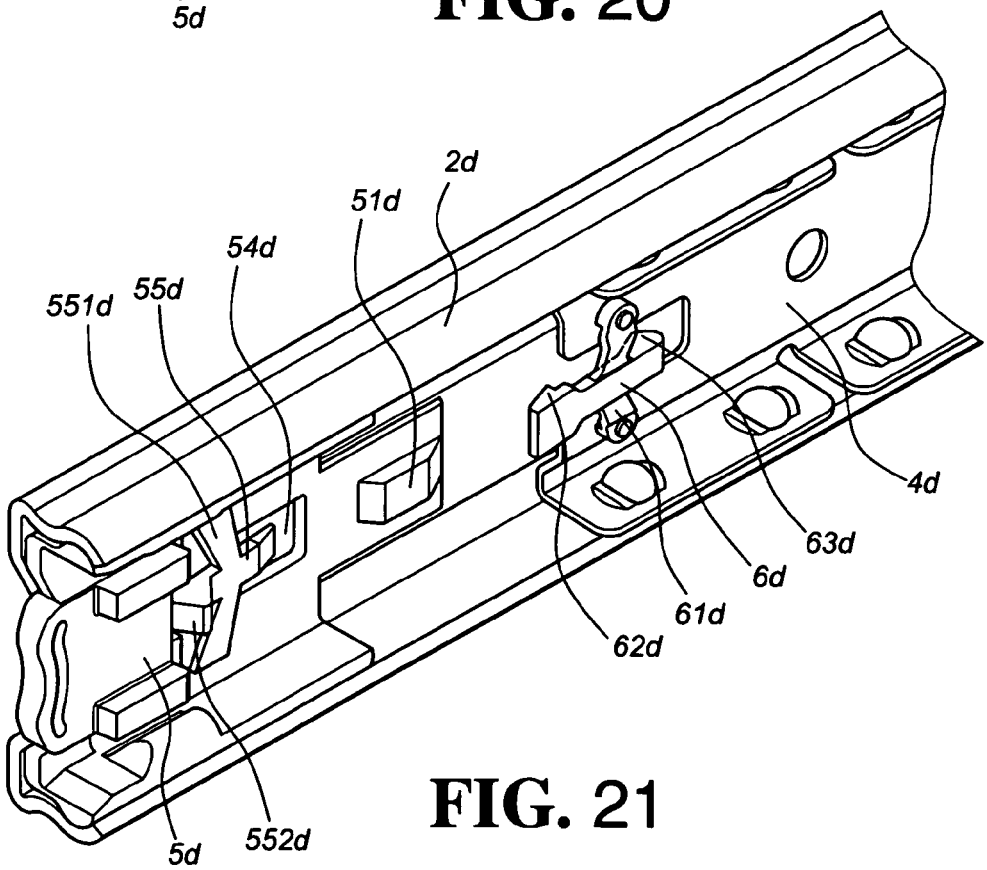
FIG. 21 is a schematic view showing a local construction of the bracket in the fifth preferred embodiment of the present invention.
Figure 22:
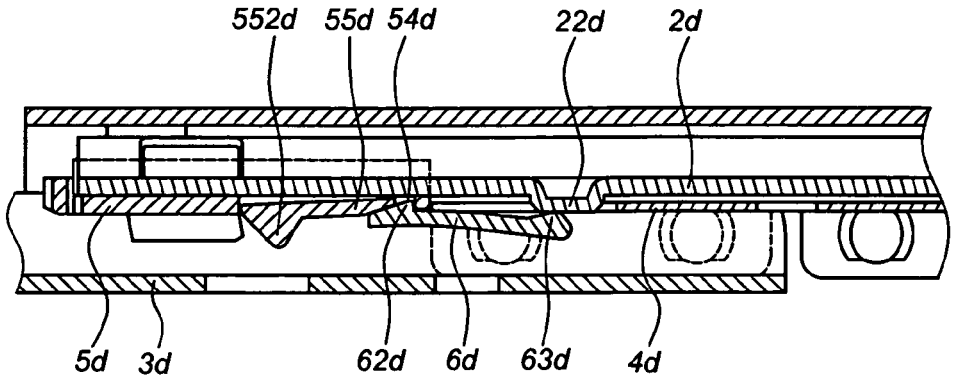
FIG. 22 is a schematic view showing the location of the bearing carrier in the fifth preferred embodiment of the present invention.
Figure 23:
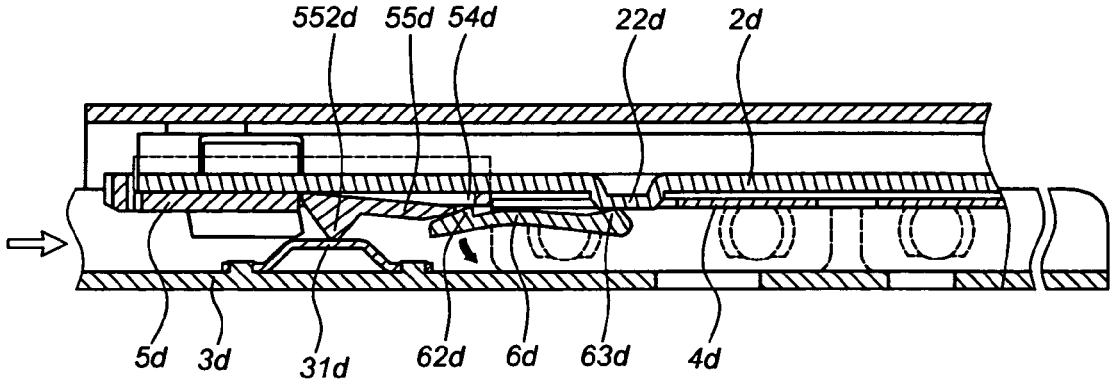
FIG. 23 is a schematic view showing that the location of the bearing carrier in the fifth preferred embodiment of the present invention is released.

In a fifth preferred embodiment of the present invention as illustrated in FIG. 20, two wings (61*d*) respectively extending from both sides of a locking piece (6*d*) are fixed to a bearing carrier (4*d*). The locking piece (6*d*) has a higher front end and a lower rear end. The front end of the locking piece (6*d*) is disposed with a hooking portion (62*d*) and the rear end of the locking piece (6*d*) is disposed with a protrusion (63*d*). A protruding portion (22*d*) is disposed on a middle rail (2*d*), or a protruding portion (51*d*) is disposed on a bracket (5*d*) as illustrated in FIG. 21. A locking hole (54*d*) is provided on the bracket (5*d*) and a rod (55*d*) is disposed at where abutted to the locking hole (54*d*). Two wings (551*d*) respectively extending from both sides of the rod (55*d*) are connected to the bracket (5*d*). The rod (55*d*) has its front end at a level higher than that of its rear end and a protrusion (552*d*) disposed at the front end. A protruding member (31*d*) is disposed on the inner side of an inner rail (3*d*) as illustrated in FIG. 23. Accordingly, as illustrated in FIG. 22, when the locking piece (6*d*) is pulled out along with the inner rail (3*d*) and brought to approach to the bracket (5*d*), the locking piece (6*d*) swings with the protrusion (63*d*) at its rear end to hold against the protruding portion (22*d*) of the middle rail (2*d*), so that hooking portion (62*d*) at its front end engages with the locking hole (54*d*) of the bracket (5*d*). Meanwhile, the hooking portion (62*d*) is abutted to where above the rear end of the rod (55*d*). When the inner rail (3*d*) is inserted into the middle rail (2*d*) as illustrated in FIG. 23, when the protruding member (31*d*) of the inner rail (3*d*) holds against the protrusion (552*d*) at the front end of the rod (55*d*), the rear end of the rod (55*d*) raises to lift up and push away the hooking portion (62*d*) at the front end of the locking piece (6*d*) from the locking hole (54*d*) of the bracket (5*d*); and consequently, the bearing carrier (4*d*) moves at the same time as the inner rail (3*d*) is pushed in.

Figure 24:
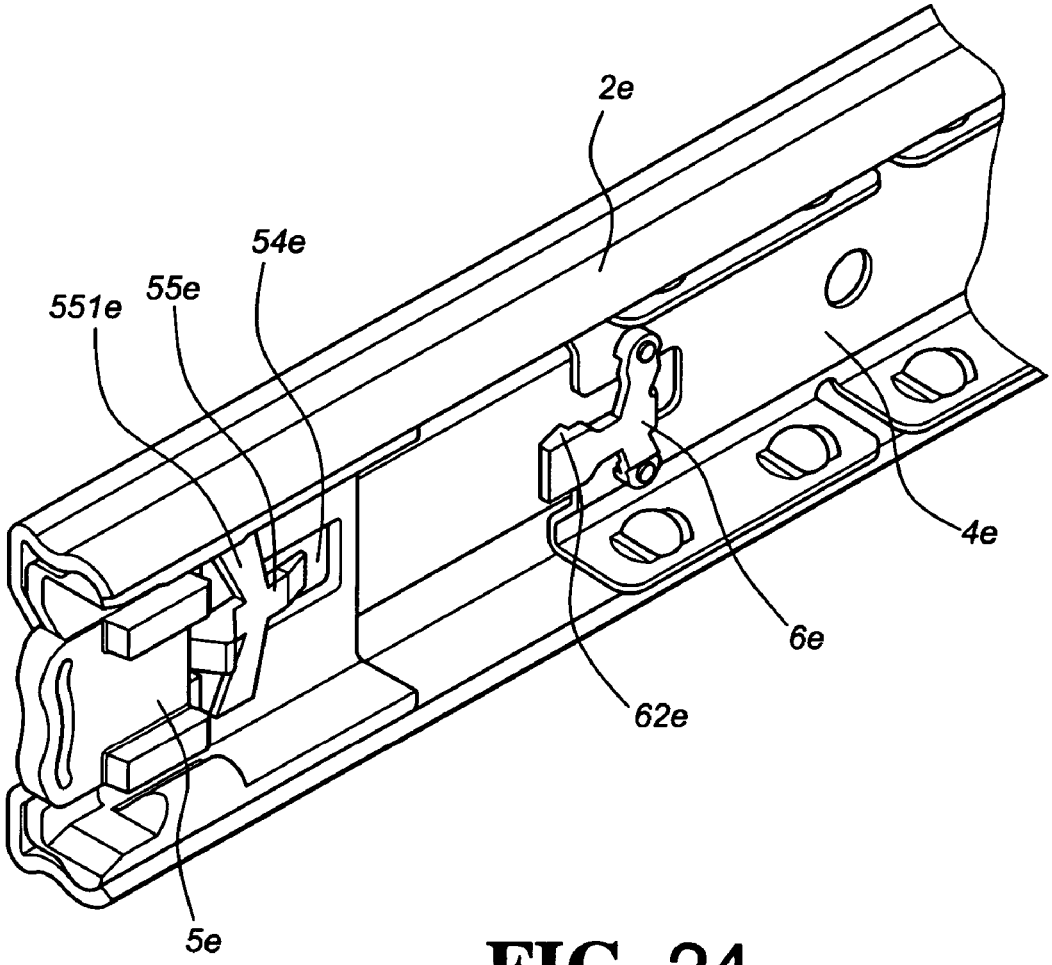
FIG. 24 is a schematic view showing a construction of a sixth preferred embodiment of the present invention.
Figure 26:
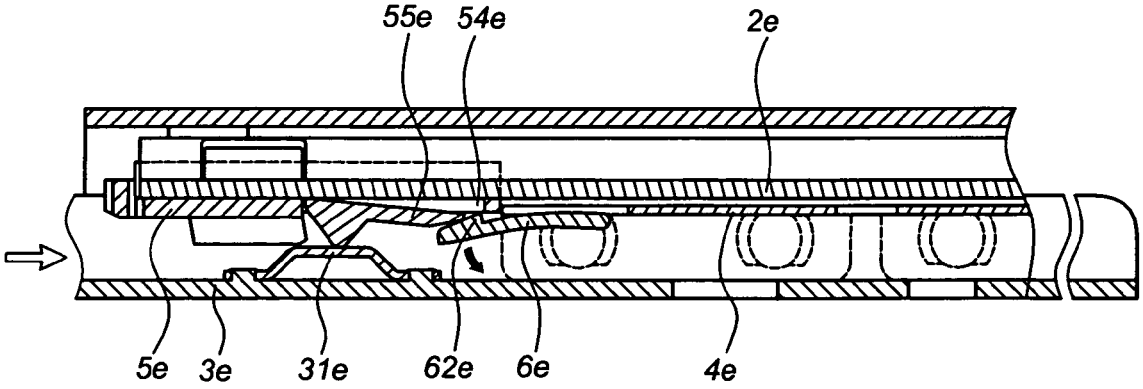
FIG. 26 is a schematic view showing that the location of the bearing carrier in the sixth preferred embodiment of the present invention is released.

In a sixth preferred embodiment of the present invention as illustrated in FIG. 24, a locking piece (6*e*) is fixed to a bearing carrier (4*e*). A hooking portion (62*e*) extends laterally from the front end of the locking piece (6*e*). A locking hole (54*e*) is disposed on a bracket (5*e*). A rod (55*e*) is disposed in the front of the locking hole (54*e*). Two wings (551*e*) respectively extending from both sides of the rod (55*e*) are connected to the bracket (5*e*). The front end of the rod (55*e*) is higher than the rear end of the rod (55*e*), and a protruding member (31*e*) is disposed on the inner side of an inner rail (3*e*), as shown in FIG. 26.

Figure 25:
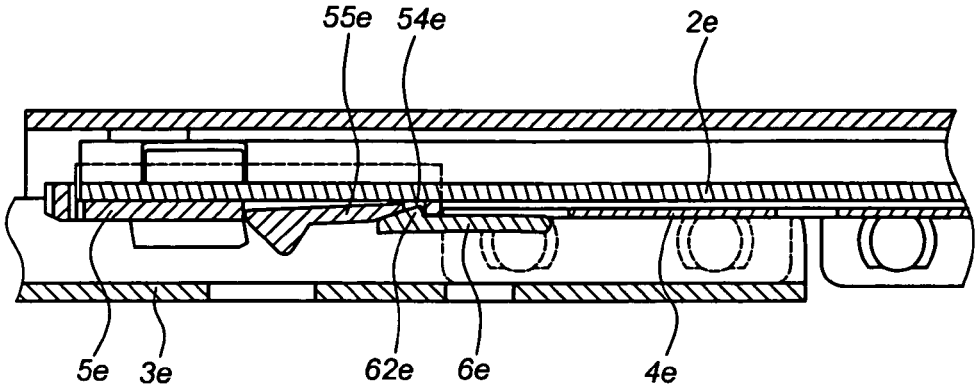
FIG. 25 is a schematic view showing the location of the bearing carrier in the sixth preferred embodiment of the present invention.

Accordingly, as illustrated in FIG. 25, when the locking piece (6*e*) is pulled out along with the inner rail (3*e*) and brought to approach the bracket (5*e*), the hooking portion (62*e*) at the front end of the locking piece (6*e*) is locked into the locking hole (54*e*), and the hooking portion (62*e*) is abutted to where above the rear end of the rod (55*e*). When the inner rail (3*e*) is inserted once again into a middle rail (2*e*). As illustrated in FIG. 26, when the protruding member (31*e*) of the inner rail (3*e*) compresses against the front end of the rod (55*e*), the rear end of the rod (55*e*) raises to lift up and push the hooking portion (62*e*) of the locking piece (6*e*) to disengage from the locking hole (54*e*) of the bracket (5*e*) for the bearing carrier (4*e*) to move as the inner rail (3*e*) is pushed in.

Figure 27:
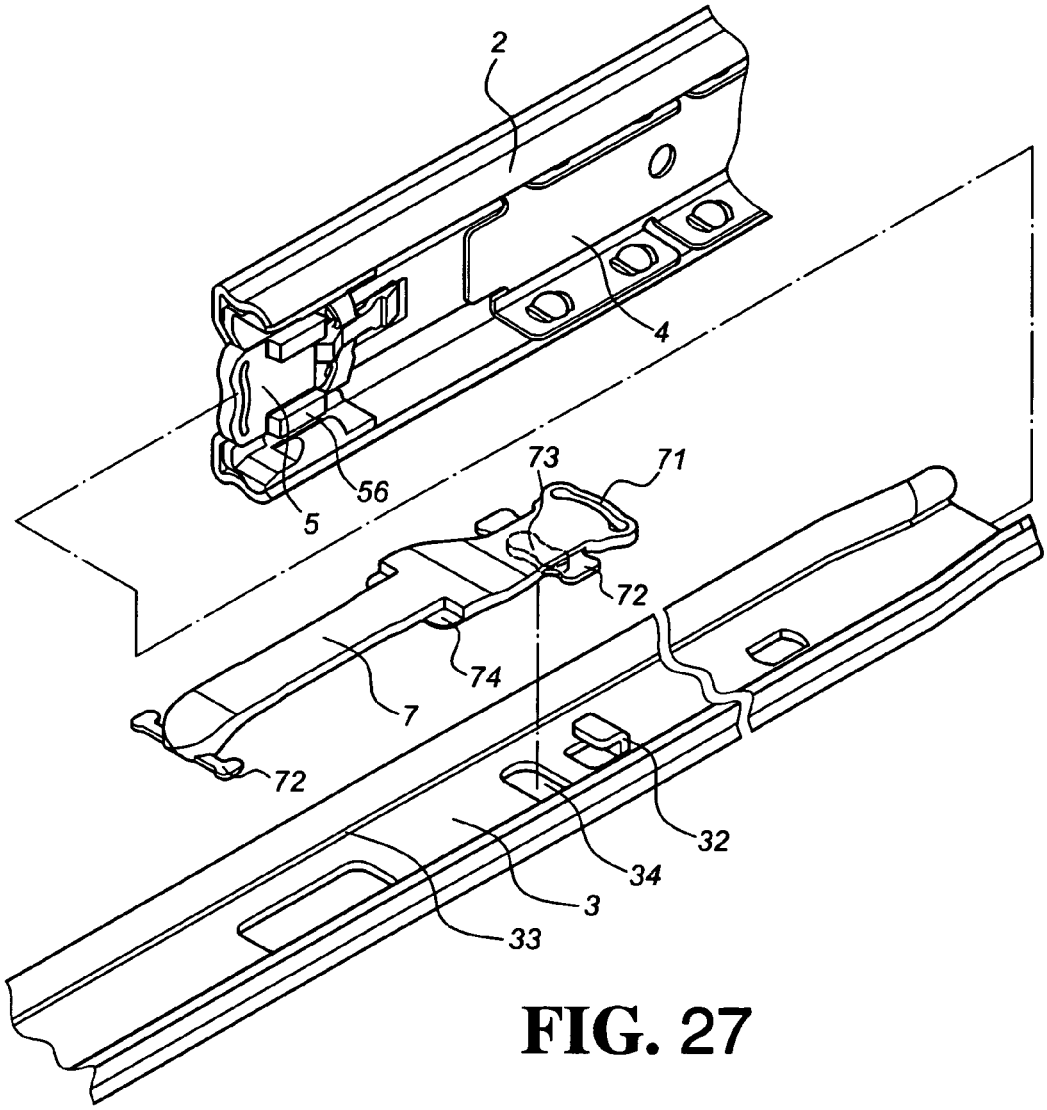
FIG. 27 is a schematic view showing a construction of a limiting piece disposed to an inner rail of the present invention.
Figure 28:
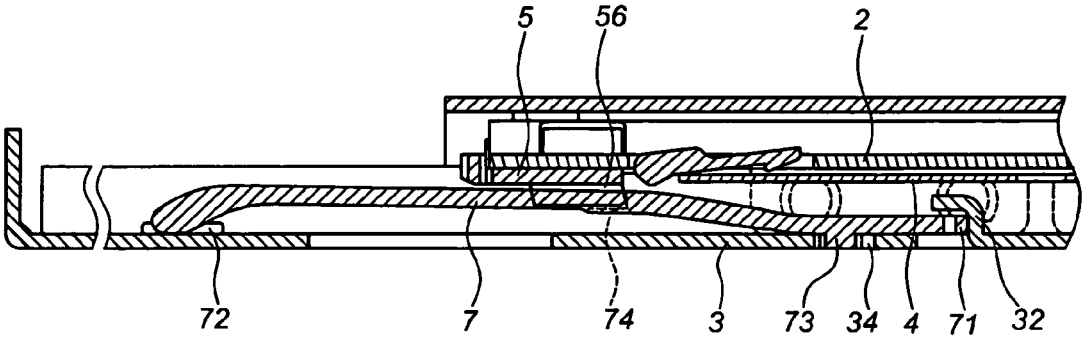
FIG. 28 is schematic view showing the cushioning effect provided to the extension of the inner rail of the present invention.

In the design of extending and locating of the inner rail (3) as illustrated in FIGS. 1 and 27. A limiting piece (7) is disposed on the inner side of the inner rail (3). The limiting piece (7) is inserted onto the inner side of the inner rail (3) and capable of executing mild sliding. One end of the limiting piece (7) is disposed with an elastic ring (71) to movably hold against a retainer (32) disposed to the inner rail (3). Two tabs (72) are respectively extending from both sides at both ends of the limiting piece (7) to extend and hold onto inner grooves (33) of the inner rail (3). A protruding block (73) is disposed to the bottom of the limiting piece (7), and a slot (34) in a size greater than that of the protruding block (73) is disposed to the inner rail (3). Both the protruding block (73) and the slot (34) are abutted 5 to each other while leaving a certain free space. Two indentions (74) are formed on the limiting piece (7) and two ribs (56) are disposed on the bracket (5) for the inner rail (3) to extend in relation to the middle rail (2). When the inner rail (3) has the indentions (74) of the limiting piece (7) holding against the ribs lo (56) to prevent the inner rail (3) from being disengaged as illustrated in FIG. 28, the elastic ring (71) of the limiting piece (7) and the retainer (32) of the inner rail (3) bump to each other to provide a cushioning effect.

Figure 29:
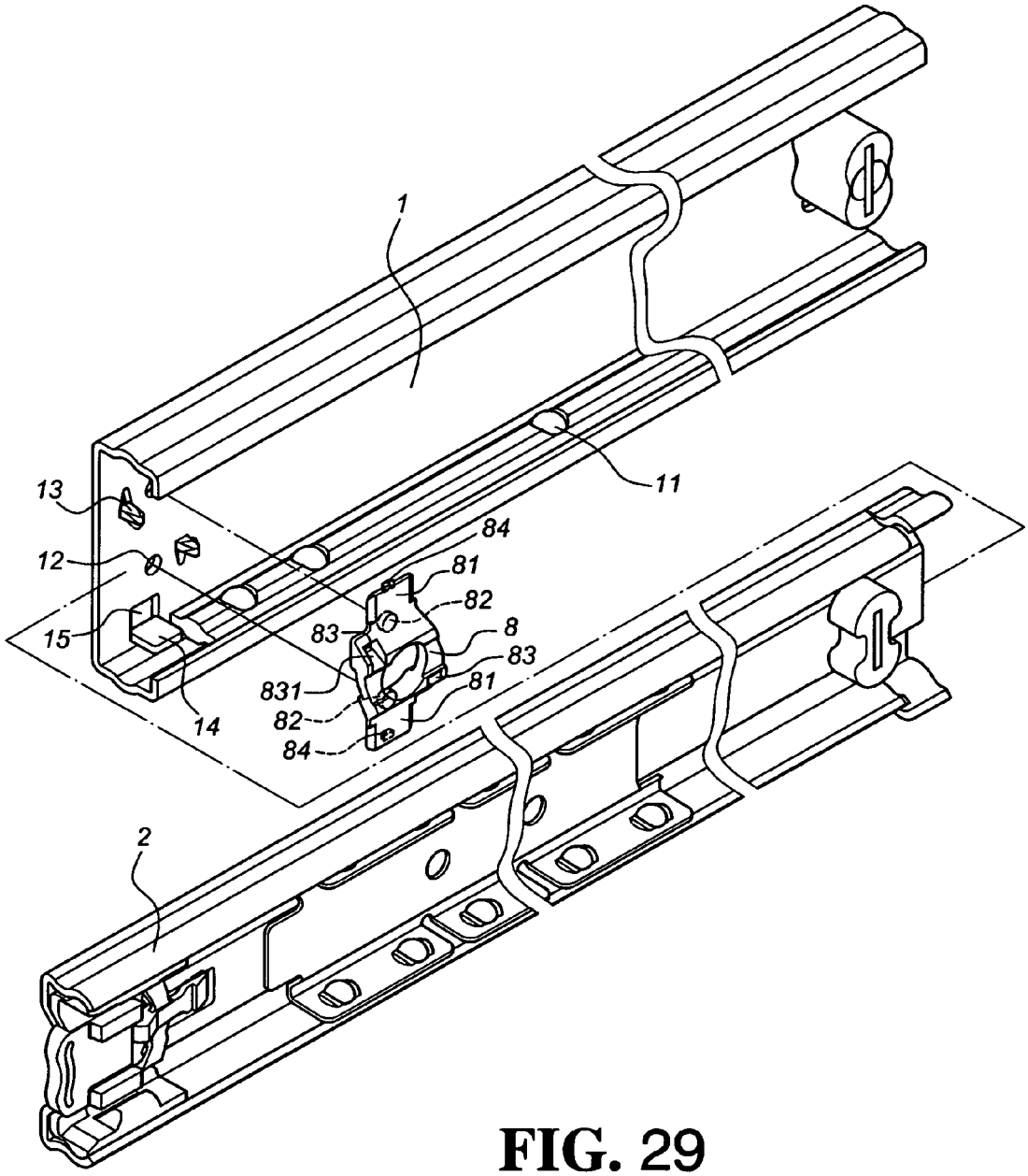
FIG. 29 is a schematic view showing a construction of a fender disposed to an outer rail of the present invention.
Figure 30:
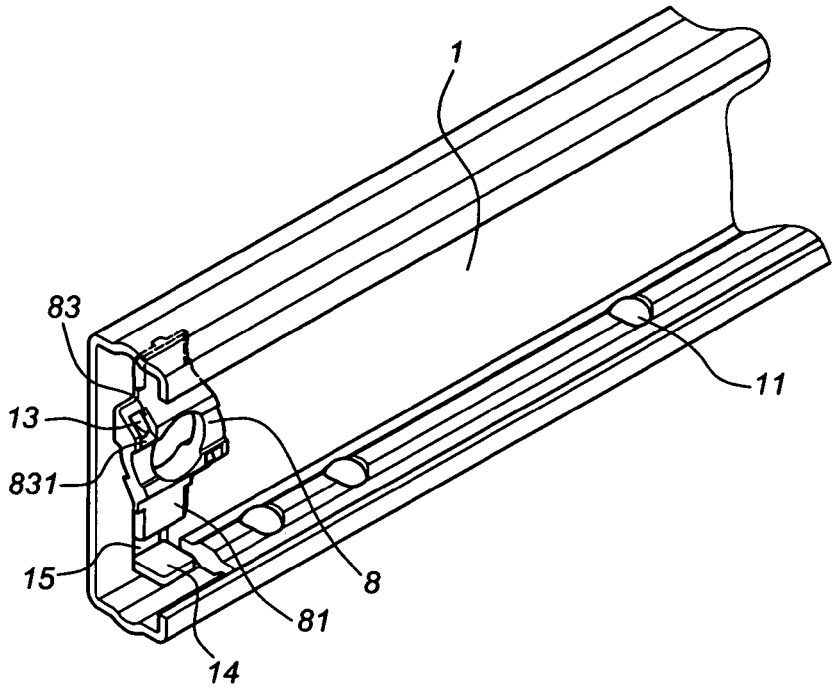
FIG. 30 is a perspective view showing an assembly of the fender disposed to the outer rail of the present invention.
Figure 31:
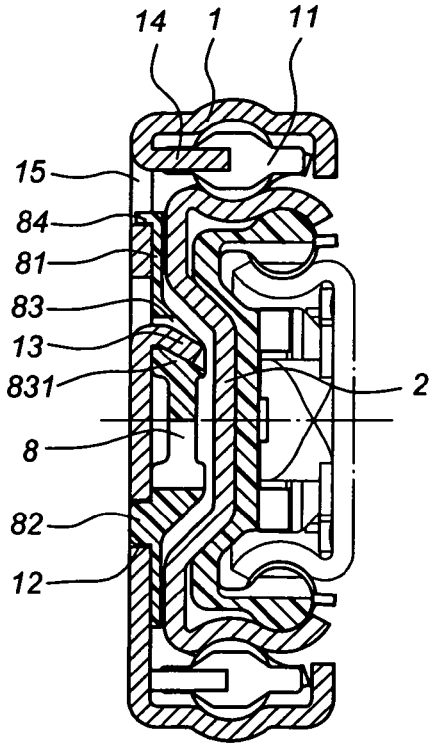
FIG. 31 is a sectional view of the assembly of the fender disposed to the outer rail of the present invention.

As illustrated in FIG. 29 for the design to prevent 15 abnormal friction that may occur between the middle rail (2) and the outer rail (1), a fender (8) containing two spacers (81) is disposed to the front end of the outer rail (1). Two locating studs (82) are disposed on the bottom of the fender (8) and two locking holes (83) are provided through the fender (8). Each locking hole 20 (83) containing a protruding gradation (831). Locating holes (12) and buckling pieces (13) corresponding to the locating studs (82) and the locking holes (83) are respectively provided on the outer rail (1). Two locking blocks (84) are disposed on the bottom of the spacers (81) of the fender (8) in relation to punched holes (15) 25 disposed at where retainers (14) to stop the ball bearings (11) on the outer rail (1) are provided. Accordingly, as illustrated in FIGS. 30 and 31, the locating studs (82) of the fender (8) engage with the locating holes (12) of the outer rail (1), and the buckling pieces (13) extend into the locking holes (83) of the fender (8), thus to force the end of each buckling piece (13) to be curved and hold against the protruding gradation (831) in the locking hole (83). Meanwhile, the locking blocks (84) are inserted into the punched hole (15) of the outer rail (1) for the fender (8) and the spacers (81) on the outer rail (1) to provide better lubrication and to eliminate abnormal noise when the outer rail (1) contacts the middle rail (2).

What is claimed is:

1. A drawer slide locating system including an outer rail, an inner rail, and a bearing carrier, the bearing carrier containing balls and being disposed between the inner rail and the outer rail, a bracket being disposed to a front end of the outer rail, the bracket being provided with a locking piece in the direction facing the bearing carrier, two wings respectively extending from both sides of the locking piece and being connected to the bracket to define a leverage axis, a slot corresponding to the locking piece being disposed on the outer rail, the locking piece comprising a first end and a second end thereof, the first end of the locking piece being lower than the bottom of the bearing carrier and the second end of the locking piece being held against by the bottom of a front end of the bearing carrier, and a hooking portion being disposed on the first end of the locking piece, a retaining surface being disposed on the bearing carrier in relation to the first end of the locking piece, and the retaining surface being a raised side of a protrusion for the retaining surface and the hooking portion of the locking piece to hold against each other.

2. The drawer slide locating system of claim 1, wherein a protruding plate is disposed to the front end of the bearing carrier and a corresponding protrusion is disposed on the second end of the locking piece.

3. The drawer slide locating system of claim 1, wherein a protruding plate is disposed to the front end of the bearing carrier and a convex is formed on the bottom of the protruding plate.

4. A drawer slide locating system including an outer rail, an inner rail, and a bearing carrier, the bearing carrier containing balls and being disposed between the inner rail and the outer rail, a bracket being disposed to a front end of the outer rail, the bracket being provided with a locking piece in the direction facing the bearing carrier, two wings respectively extending from both sides of the locking piece and being connected to the bracket to define a leverage axis, a slot corresponding to the locking piece being disposed on the outer rail, the locking piece comprising a first end and a second end thereof, the first end of the locking piece being lower than the bottom of the bearing carrier and the second end of the locking piece being held against by the bottom of a front end of the bearing carrier, and a hooking portion being disposed on the first end of the locking piece, a retaining surface being disposed on the bearing carrier in relation to the first end of the locking piece, and the retaining surface being a concave side of a pit for the retaining surface and the hooking portion of the locking piece to hold against each other.

5. A drawer slide locating system including an outer rail, an inner rail, and a bearing carrier, the bearing carrier containing balls and being disposed between the inner rail and the outer rail, a bracket being disposed to a front end of the outer rail, the bracket being provided with a locking piece in the direction facing the bearing carrier, two wings respectively extending from both sides of the locking piece and being connected to the bracket to define a leverage axis, a slot corresponding to the locking piece being disposed on the outer rail, the locking piece comprising a first end and a second end thereof, the first end of the locking piece being lower than the bottom of the bearing carrier and the second end of the locking piece being held against by the bottom of a front end of the bearing carrier, and a hooking portion being disposed on the first end of the locking piece, a retaining surface being disposed on the bearing carrier in relation to the first end of the locking piece; and the retaining surface being an edge surface of a through hole for the retaining surface and the hooking portion of the locking piece to hold against each other.

* * * * *